United States Patent [19]

Altherr et al.

[11] Patent Number: 4,549,666

[45] Date of Patent: Oct. 29, 1985

[54] RAILWAY VEHICLE DRAFT SILL AND SLACKLESS DRAFT ASSEMBLY

[75] Inventors: Russell G. Altherr, Munster, Ind.; Steven F. Schmitt, Arlington Heights, Ill.

[73] Assignee: AMSTED Industries Incorporated, Chicago, Ill.

[21] Appl. No.: 431,246

[22] Filed: Sep. 30, 1982

[51] Int. Cl.[4] ..... B61G 5/02; B61D 3/10

[52] U.S. Cl. ..... 213/62 A; 105/3; 105/420; 213/69; 213/182

[58] Field of Search ..... 105/3, 4 R, 199 C, 42 D; 213/50, 50.5, 51, 61, 62 R, 62 A, 64, 69, 72, 75 R, 78, 182, 183, 184, 208, 210

[56] References Cited

U.S. PATENT DOCUMENTS

| | | | |
|---|---|---|---|
| Re. 29,011 | 10/1976 | Altherr | 213/64 |
| 603,298 | 5/1898 | Ullman | 213/184 |
| 1,443,716 | 1/1923 | Pletcher | 213/62 R X |
| 2,282,146 | 5/1942 | Mealing et al. | 213/62 A X |
| 2,327,240 | 8/1943 | Barrows et al. | 213/62 A X |
| 3,422,771 | 1/1969 | Giesking | 105/3 |
| 3,716,146 | 2/1973 | Altherr | 105/4 R X |
| 3,760,954 | 9/1973 | Hershey et al. | 213/69 |
| 4,258,628 | 3/1981 | Altherr | 105/199 C X |
| 4,336,758 | 6/1982 | Radwill | 105/420 X |
| 4,386,880 | 6/1983 | Schimmeyer | 213/184 X |
| 4,422,557 | 12/1983 | Altherr | 105/3 X |

*Primary Examiner*—Randolph A. Reese
*Assistant Examiner*—David F. Hubbuch
*Attorney, Agent, or Firm*—Edward J. Brosius; Charles E. Bouton

[57] ABSTRACT

A railway draft sill and slackless draft assembly including a pair of lengthwise spaced draft sills having a drawbar extending therebetween. One of the drawbar ends is connected for rotation relative to one of the draft sills and the other end is fixed against rotation relative to the other draft sill. Slack take-up structure is are provided to maintain bearing surfaces at the respective attachment ends in engagement when wear occurs.

5 Claims, 6 Drawing Figures

RAILWAY VEHICLE DRAFT SILL AND SLACKLESS DRAFT ASSEMBLY

BACKGROUND OF THE INVENTION

The present invention relates to railway vehicles and more particularly to an arrangement for providing a slackless connection between adjacent ends of railway vehicle units.

Railway vehicle drawbar arrangements of the type to which the present invention relates are normally used in unit train operation wherein a single commodity such as coal, grain or the like is transported from the point of origin to its destination without requiring uncoupling. In such unit trains the usual separable and interlocking couplers may be dispensed with because it is not required to assemble the cars in classification yards or the like.

It has been proposed to replace such separable couplers with a single drawbar extending between adjacent vehicle units and semi-permanently attaching each of the ends as by keying or pinning to the vehicles. Such arrangements while satisfactory have generally introduced the element of slack into the trainline operation as a result of the required loose fit between the key and keyslot to permit horizontal and vertical angling of the drawbar relative to vehicles during normal trainline operation.

In some applications of unit train operation it may be desirable that one end of the drawbar be fully rotatably attached to one of the vehicle units and the other fixed against rotation so as to permit 360° turning of the vehicle to dump the load while the other vehicle or unit remains stationary. Heretofore such rotary arrangements have been incorporated in separable or articulated coupler arrangements.

The prior art drawbar arrangements, because of the rigidity and length of the bar extending between the vehicle units, oftentimes generate stability problems during normal train operation as during the negotiation of curves. It has been discovered that a decrease of the distance between the pivot point about which the vehicle pivots relative to the drawbar and the axis of the center plate immediately inboard of the end to which the pulling drawbar is connected results in decreasing the critical lateral force acting on the truck center pin tending to derail the car.

SUMMARY OF THE INVENTION

By the present invention it is proposed to provide a drawbar system which is capable of being easily and simply applied to an existing railway vehicle structure without requiring considerable modification. The system is so constructed as to facilitate the construction of new railway vehicles.

Basically the drawbar system comprises bearing blocks which are disposed and supported in the respective draft sills of a railway vehicle. The bearing blocks are formed with a concave spherical surface.

An elongated drawbar having end portions extends into pockets defined by the draft sills. Each of the drawbar end portions are provided with terminal ends shaped as a convex spherical surface. The bearing block spherical concave surfaces and the drawbar spherical convex surfaces mate and are concentric whereby the drawbaw is permitted to angle horizontally and vertically relative to the draft sill.

The drawbar end portions are suitably each keyed to the draft sills to form in the nature of a semi-permanent connection. Semi-permanent as defined herein defines the condition wherein the key must be manually removed in order to separate the drawbar end portion from the draft sill. This is in contrast to the usual coupler structure wherein it is only necessary to release a lock such that the couplers and thereby the vehicles are separated by a pulling force.

In one form of the invention the keying means comprises a keyslot formed in the end portions of the drawbar with a key extending therethrough and through the draft sill. The inboard end of the keyslot is formed with a concave arcuate surface which is engageable with a convex arcuate surface of a key bearing block disposed on the inboard side of the keyslot. The opposite side of the key bearing block is formed with a cylindrical concave surface which engages a convex cylindrical surface on the key. The centers of curvature of the bearing surfaces on the bearing block, key bearing block and keyslot lie on substantially the same center to permit the drawbar to angle both vertically and horizontally relative to the draft sill.

In another form of the invention at least one end of the drawbar is provided with a substantially complete spherical surface which is engageable with the convex spherical bearing block surface on one side and is engageable with concave surfaces on the other side. This structure permits 360° rotation of the vehicle about the longitudinal axis of the drawbar.

In each of the foregoing arrangements the bearing block is supported on the draft sill end of the center sill and is disposed adjacent to an upright wall or stop on the draft sill. To compensate for wear on the bearing surfaces at the bearing block a gravity urged wedge shaped member is disposed between the bearing block and the stop so that the bearing surfaces are maintained in contact when wear occurs.

In order to reduce the lateral forces at the center plate of the railway vehicles tending to cause derailment the present invention provides a draft sill having a center pin opening and a stop wall in close proximity thereto. With this arrangement the pivot point of the drawbar and the axis of the railway vehicle are maintained in close proximity so as to reduce forces on the center plate, tending to cause derailment.

DESCRIPTION OF THE PREFERRED EMBODIMENT

Figure 1:
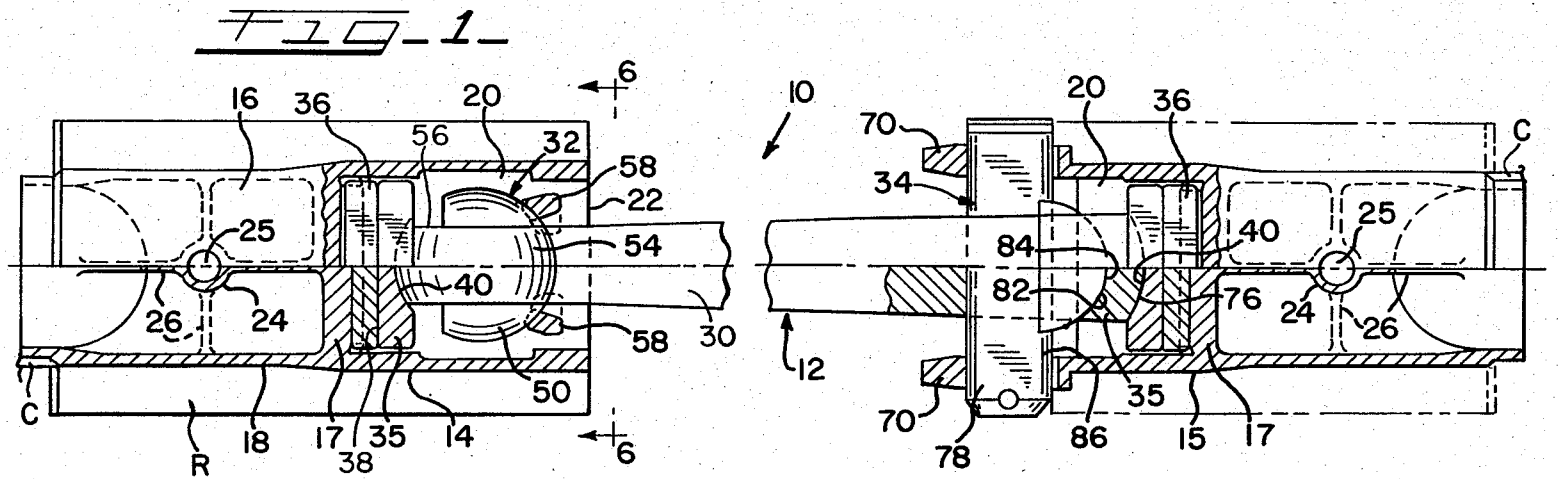
FIG. 1 is a fragmentary top plan view partially in section of a draft assembly embodying the structure of the present invention.

Referring now to the drawings there is shown a draft assembly 10 including a drawbar assembly 12 and a pair of draft sills 14 and 15. The draft sills 14 and 15 are adapted to be fixed to the center sills of railway vehicles (not shown).

The draft sills 14 and 15 may be fabricated from metal channels, plates or the like or may be made by a metal casting as shown. The draft sill 14 includes a top wall 16 spanning a pair of laterally spaced side walls 18. An intermediate wall 17 extending between the side walls 18 defines the inner end of a pocket 20 having an open end 22.

The inboard section of the draft sills 14 and 15 are each provided with an upstanding or tubular center pin support 24 having a center pin opening 25 for accommodating the center pin (not shown). The tubular center pin support 24 is held fixed by means of webs 26 extending respectively between the inboard face of the inner wall 17 and inboard walls 18. A lower generally cylindrical projection defines a body center plate 29 which mates with a truck bolster center plate (not shown) in the conventional manner.

The draft sills 14 and 15 are each secured to a center sill C of a railway car so that the pocket opening lies in proximity to the striker plate assembly (not shown).

The drawbar assembly 12 includes an elongated drawbar 30 having a rotatable end 32 at one end thereof mounted in the draft sill 14 and a fixed end 34 at the other end thereof mounted to the draft sill 15. Associated with the ends of the drawbar are bearing blocks 35 and slack take-up devices 36 to maintain the ends fixed against lengthwise movement relative to the respective draft sills 14 and 15.

The bearing blocks 35 in each of the draft sills 14 and 15 may be of similar construction including a substantially planar inboard wall 38 and an outboard bearing wall 40. The outboard bearing wall 40 is concave and preferably spherical of which the radius of curvature lies in close proximity to the vertical axis of the center plate 29.

The slack take-up device as shown is in the form of a wedge having an inclined face 42 in engagement with a complementary inclined surface 44 on the outboard side of the intermediate wall. The opposite face 46 engages the inboard face of the bearing block so as to provide support for the latter.

Figure 6:
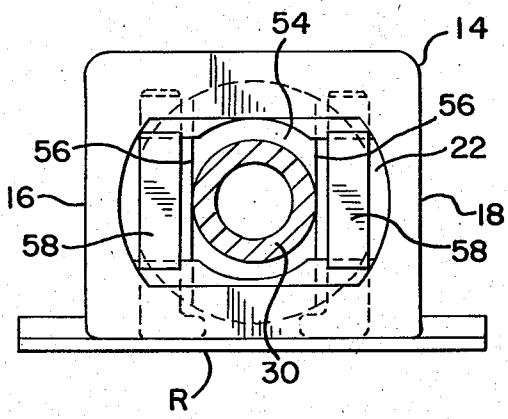
FIG. 6 is an end view taken generally along the lines 6—6 of FIG. 1.
Figure 2:
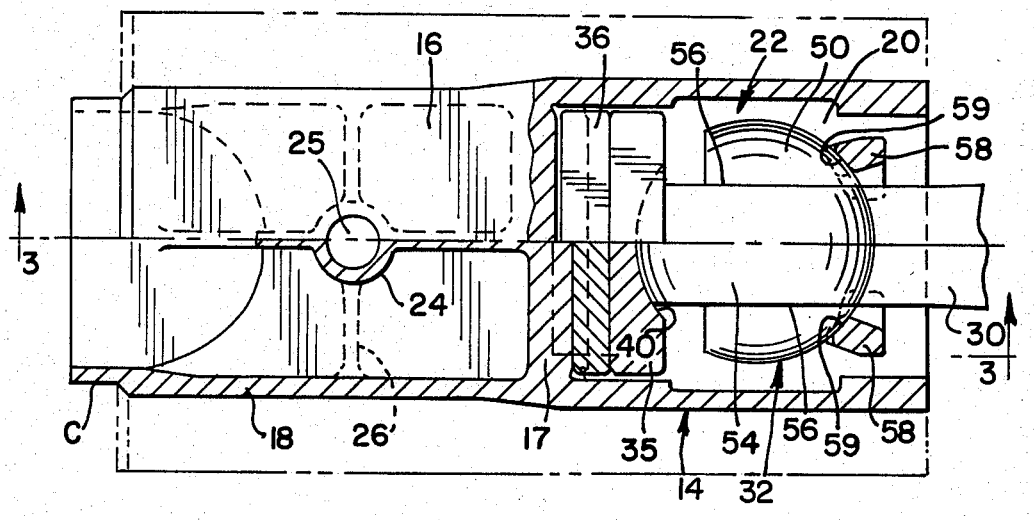
FIG. 2 is an enlarged fragmentary plan view partially in cross section, of the rotary end of the draft assembly shown in FIG. 1.
Figure 3:
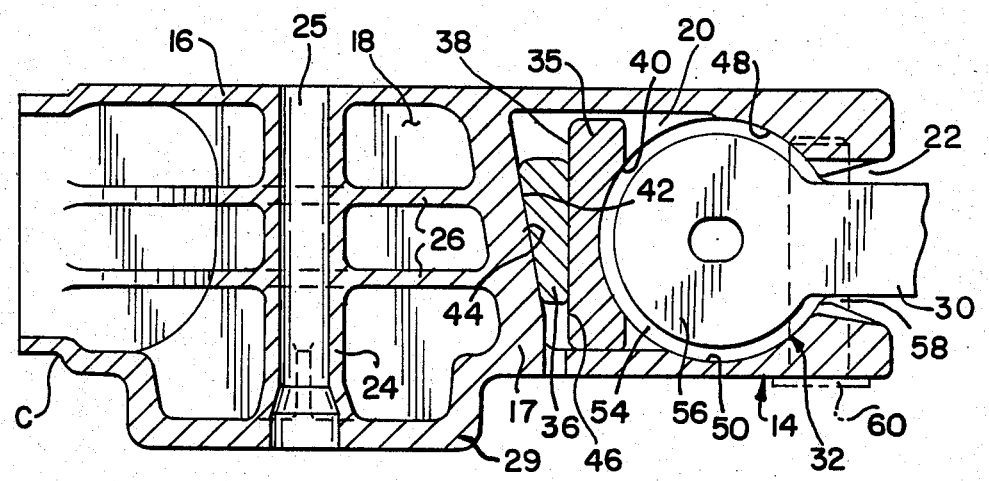
FIG. 3 is cross sectional view taken generally along the lines 3—3 of FIG. 2.

Referring now to FIGS. 2, 3 and 6 the walls of the pocket 20 of the draft sill 14 are formed with concentric concave spherical surfaces 48 and 50, which are engageable and concentric with the surface of the rotary end of the drawbar as to be explained. The opening 22 into the pocket 20 is transversely horizontally elongated to accommodate the rotary end 32 of the drawbar.

The rotary end 32 has a spherical surface 54 and two spaced flat surfaces 56 on opposite sides of the spherical center. The flat surfaces are spaced apart a lesser distance than the vertical distance of the opening 22 to permit insertions of the drawbar 30 therethrough. After insertion of the drawbar 30 through opening the former is turned 90° so that the spherical surface 54 engages and mates with the concave surfaces 48 and 50 in the pocket 20 as shown.

To prevent separation or removal of the drawbar 30 from the pocket 20 there are provided a pair of laterally spaced posts 58—58 having concave spherical surfaces 59 which are engageable with and concentric to the spherical surface 54 to permit 360° rotation of the drawbar relative to the draft sill 14. The posts 58—58 are retained in openings provided in the draft sill walls by means of a retainer plate R fixed across the base of the draft sill.

It is to be noted the concave spherical bearing block surface 40 and the concave key spherical surfaces 48 and 50 are concentric so that the rotatable spherical end 32 is held snuggly embraced at diametrically opposed sides and fixed against lengthwise movement relative to the draft sill 14. If wear should occur at the engaging bearing surfaces the wedge 36 is operative to drop and take-up any slack between the walls 38 and 44.

The opposite or fixed end 34 of the drawbar is inserted in the pocket 20 of the draft sill which as above described contains a bearing block 35 and a wedge 36 identical to the draft sill 14.

The terminal end of the drawbar is provided with a convex spherical surface 76 concentric to the bearing block concave surface 40. Retaining the surfaces in engagement is a key 78 which is supported by keyway projections 70 projecting from the sidewalls of the pocket 20.

The key 78 which is of generally rectangular cross section with semi-cylindrical ends extends through a keyway 71 formed in the end portion of the drawbar 30. The inboard section of the keyway 71 is formed with generally parallel horizontal edges 72 and with outwardly flaring edges 74 at its outboard end. This permits the drawbar to angle vertically about the center of curvature of the concentric surfaces 40 and 76.

Figure 4:
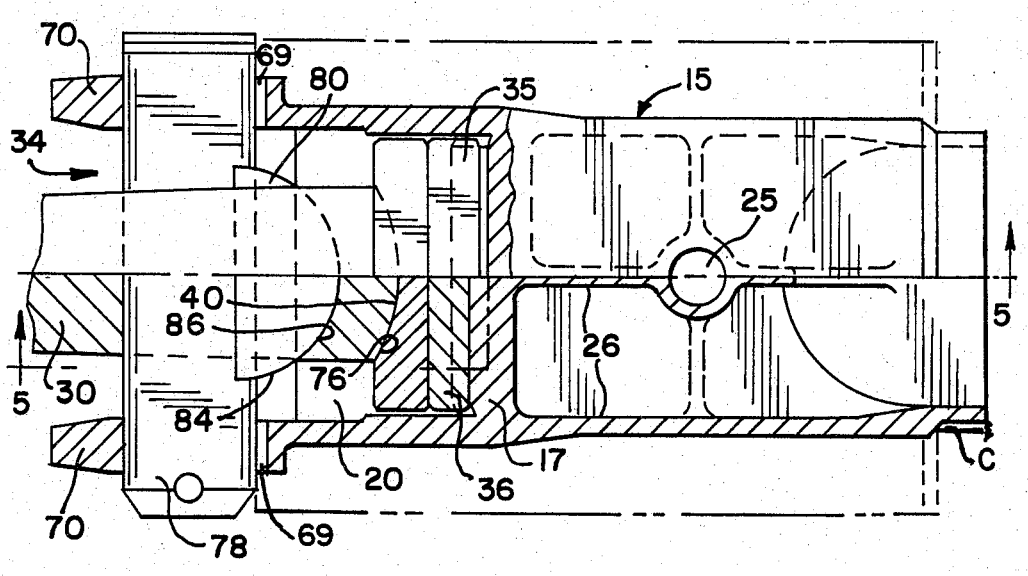
FIG. 4 is an enlarged fragmentary plan view of the fixed end of the draft assembly shown in FIG. 1.
Figure 5:
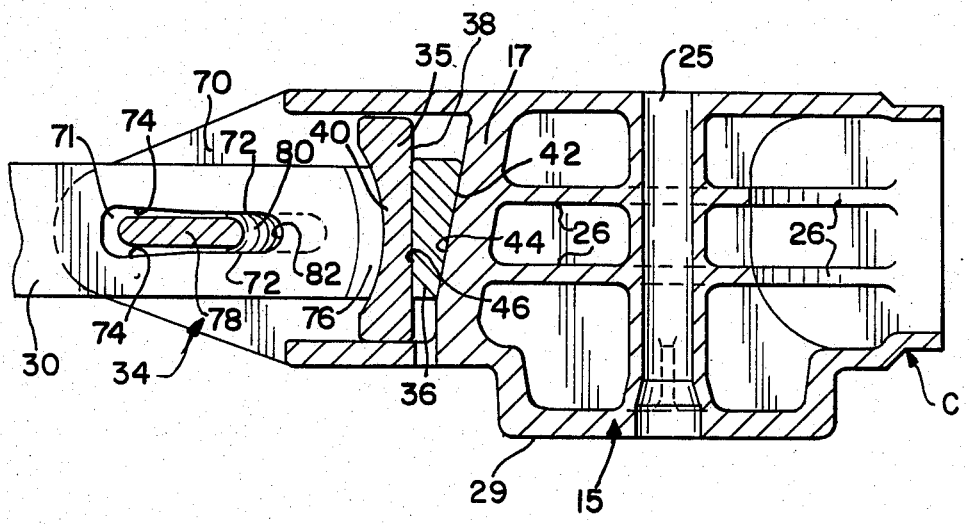
FIG. 5 is a cross sectional view taken generally along the line 5—5 of FIG. 4.

Disposed in keyway 71 between key 78 is a bearing block 80 having an inboard generally arcuate surface 82 which engages a complementary arcuate surface 86 formed on the edge of the drawbar. The key 78 as shown in FIG. 4 is thus firmly held against the outboard edge of the keyway 71 in the keyway projections 70 fixed to the sill side walls. In this manner the fixed drawbar end 34 is held against lengthwise movement relative to the sill 15. At the same time, however, because of the concentric bearing surfaces 40, 76, 82 and 84 the fixed end 34 is free to angle horizontally relative to draft sill 14 or 15 and also angle vertically within the limits of the diverging wall spacing 74 of the drawbar keyway slot 71.

It should be readily apparent that the centers of curvature of the concentric surfaces 40, 76, 82 and 84 are in close proximity to the vertical axis of the center plate bore 25. Preferably the centers of curvature of these bearing surfaces on the fixed end 34 are spaced from the vertical axis of the center plate 29 about the same as the spacing of the center of curvature of the bearing surfaces 40, 54, 48, 50 and 59 from the vertical axis of the center plate on draft sill 14 on the rotary end 32. In this manner the lateral forces acting on the center plates during normal car operation on curves or the like is reduced or maintained at a minimum.

As heretofore mentioned the rotary end permits 360° rotation of the railway car or vehicle to which the draft sill is attached to be rotated for dumping. Generally, such railway vehicles are rotated about 150°. In the arrangement as shown the spherical surfaces 54 on the rotary end remain in engagement with the bearing surfaces 40, 48, 50 and the bearing surfaces 59—59 on the respective posts 58—58 during such rotation. It is to be noted that the posts 58—58 prevent the drawbar from becoming separated from the draft sill 14 when the car or vehicle is rotated 90° from the position shown in FIGS. 2 and 3.

At the same time the drawbar 30 is held fixed against rotation by the keyed attachment of the fixed end 34 to the draft sill 15 of an adjacent vehicle.

After the rotated car is unloaded it is returned to the position shown for normal train operation. Should the bearing surfaces on either the rotary end or fixed end wear, the slack take-up devices under the force of gravity slide downwardly to move the bearing plates 36 outboard and thereby maintain slackless connections at both the rotary and fixed ends.

What is claimed is:

1. A railway vehicle draft sill and slackless draft assembly for connecting adjacent rotary dump railway vehicle units, said assembly comprising, a pair of lengthwise spaced draft sills, said draft sills each including a frame adapted to extend from a railway vehicle center sill, said frame including a center plate having a center pin opening and a drawbar receiving pocket having a fixed end wall at the inboard end thereof in close proximity to the vertical axis of said center pin opening, bearing wall means supported in said pocket and having a spherical bearing surface, means maintaining said bearing wall means in fixed spaced relationship to said draft sill end wall, an elongated drawbar having opposite end portions extending into respective ones of said draft sill drawbar pockets, said end portions each being provided with spherical ends engaging with said spherical wall bearing surfaces whereby said draft sills and said drawbar are turnable relative to each other, means keying one of said ends in a respective drawbar pocket to limit said relative turning between said drawbar and said draft sill, and means mounting the other end of said drawbar in the other of said draft sill drawbar pockets so as to permit relative rotation of said drawbar and draft sill in the dumping mode, the centers of said spherical surfaces at each of said ends of said drawbar defining the respective turning axis at each of said drawbar ends and being in close proximity to the upstanding axis of said center pin opening.

2. The invention as defined in claim 1 wherein said means connecting said one end to said one draft sill comprises a key, a keyway formed in said end portion, a bearing block supported in said keyway, said keyway bearing block and keyway wall each being formed with complementary arcuate surfaces having a center of curvature common to said turning axis.

3. The invention as defined in claim 1 or 2 wherein said other end is formed with a spherical end, said spherical end extending into said pocket of said other of said draft sills, and engaging said concave spherical bearing wall surface, stop means extending across the open end of said pocket for preventing separation of said drawbar rotary end from said draft sill, and concave bearing surfaces on said stop means engageable with said spherical end.

4. The invention as defined in claim 3 wherein said maintaining means comprises slack take-up means disposed between said fixed end wall and said bearing wall means for taking up slack when said bearing surfaces on said bearing wall means of said rotary or fixed ends wear.

5. The invention as defined in claim 4 wherein said slack take-up comprises a wedge having an inclined surface in engagement with a complementary inclined surface on said fixed end wall.

* * * * *